US006639451B2

(12) United States Patent
Conte et al.

(10) Patent No.: US 6,639,451 B2
(45) Date of Patent: Oct. 28, 2003

(54) CURRENT REFERENCE CIRCUIT FOR LOW SUPPLY VOLTAGES

(75) Inventors: Antonino Conte, Tremestieri Etneo (IT); Oreste Concepito, Palermo (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 0 days.

(21) Appl. No.: 10/133,216

(22) Filed: Apr. 26, 2002

(65) Prior Publication Data

US 2002/0196071 A1 Dec. 26, 2002

(30) Foreign Application Priority Data

Apr. 27, 2001 (EP) ..... 01830275

(51) Int. Cl.[7] ..... G05F 1/10
(52) U.S. Cl. ..... 327/538
(58) Field of Search ..... 327/530, 534, 327/538, 539, 543, 544

(56) References Cited

U.S. PATENT DOCUMENTS 6,031,365 A 2/2000 Sharpe-Geisler
6,087,820 A 7/2000 Houghton et al.
6,348,832 B1 * 2/2002 Chih ..... 327/538
6,356,064 B1 * 3/2002 Tonda ..... 323/313
6,531,911 B1 * 3/2003 Hsu et al. ..... 327/512
6,535,053 B2 * 3/2003 Forsyth ..... 327/539

FOREIGN PATENT DOCUMENTS

DE 196 20 181 C1 9/1997
EP 0 539 136 A2 4/1993
EP 0 714 055 A1 5/1996

* cited by examiner

*Primary Examiner*—Jeffrey Zweizig
(74) *Attorney, Agent, or Firm*—Lisa K. Jorgenson; Stephen Bongini Fleit, Kain, Gibbons, Gutman & Bongini P.L.

(57) ABSTRACT

A current reference circuit for low supply voltages is provided. The current reference circuit includes a series including a resistor and a diode, a current source having one terminal coupled to a supply voltage and another terminal coupled to the series, an operational amplifier having its negative electrode connected to a band gap reference voltage, and a transistor. The diode has its cathode electrode coupled to ground and its anode electrode coupled to the resistor. The transistor has its gate electrode coupled to the output of the operational amplifier, its source electrode coupled to ground, and its drain electrode coupled to both the positive electrode of the operational amplifier and the current source. Also provided are an integrated circuit that includes at least one current reference circuit for low supply voltages and a signal processing system that includes at least one current reference circuit for low supply voltages.

24 Claims, 5 Drawing Sheets

CURRENT REFERENCE CIRCUIT FOR LOW SUPPLY VOLTAGES

CROSS-REFERENCE TO RELATED APPLICATIONS

This application is based upon and claims priority from prior European Patent Application No. 01-830275.2, filed Apr. 27, 2001, the entire disclosure of which is herein incorporated by reference.

BACKGROUND OF THE INVENTION

1. Field of the Invention

The present invention relates to electronic circuits, and more specifically to a current reference circuit for low supply voltages such as a 1V supply voltage.

2. Description of Related Art

It is known to a person of ordinary skill in the relevant art that analog electronic circuitry needs current reference circuits and voltage reference circuits.

These current reference circuits have to be insensitive to the thermal changes and insensitive to the supply voltage oscillations.

Usually a bandgap voltage circuit is a way to generate the current reference.

However, if the bandgap voltage circuits do not work correctly, for example because the supply voltage decreases under a prefixed value, or because the supply voltage presents excessive oscillations or because the supply voltage is not stable in temperature, then the current reference circuits do not work correctly.

Particularly, in the case in which the voltage supply decreases under a threshold voltage value, for example under 1.5V, the voltage reference circuit cannot provide a stable reference voltage and, therefore, the current reference circuit cannot generate a stable current reference.

SUMMARY OF THE INVENTION

In view of these drawbacks, it is an object of the present invention to overcome the above-mentioned drawbacks and to provide a current reference circuit that is able to provide a reference current stable in temperature.

Another object of the present invention is to realize a reference current circuit that is able to provide a reference current that is stable in temperature in the presence of a low supply voltage.

Yet another object of the present invention is to employ devices implemented only in HCMOS technology, so that it is possible to be realized in a great variety of CMOS processes.

A further object of the present invention is to realize a current reference circuit with low power consumption in all working conditions, independent from the supply voltage.

One embodiment of the present invention provides a current reference circuit for low supply voltages. The current reference circuit includes a series including a resistor and a diode, a current source having one terminal coupled to a supply voltage and another terminal coupled to the series, an operational amplifier having its negative electrode connected to a band gap reference voltage, and a transistor. The diode has its cathode electrode coupled to ground and its anode electrode coupled to the resistor. The transistor has its gate electrode coupled to the output of the operational amplifier, its source electrode coupled to ground, and its drain electrode coupled to both the positive electrode of the operational amplifier and the current source.

Another embodiment of the present invention provides an integrated circuit that includes at least one current reference circuit for low supply voltages.

Yet another embodiment of the present invention provides a signal processing system that includes at least one current reference circuit for low supply voltages.

Other objects, features, and advantages of the present invention will become apparent from the following detailed description. It should be understood, however, that the detailed description and specific examples, while indicating preferred embodiments of the present invention, are given by way of illustration only and various modifications may naturally be performed without deviating from the present invention.

DETAILED DESCRIPTION OF PREFERRED EMBODIMENTS

Preferred embodiments of the present invention will be described in detail hereinbelow with reference to the attached drawings.

Figure 1:
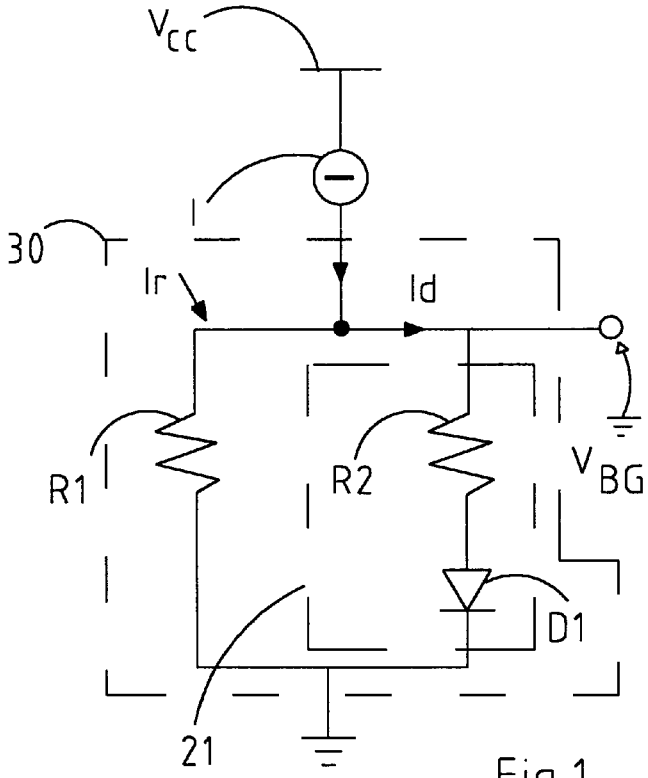
FIG. 1 shows an output stage of a conventional bandgap reference circuit.

In FIG. 1 an output stage of a conventional bandgap reference circuit is shown. A reference voltage is obtained by mirroring on a single double pole 30, made by a diode D1 and two resistors R1 and R2, of a current I, which is proportional as shown in the following relationship:

$$I \propto V_T/R \tag{1}$$

where $V_T$ is the thermal voltage, expressed by the formula:

$$V_T = K*T/q \tag{2}$$

As shown in FIG. 1, a supply voltage Vcc is connected to a current source I. The current source I supplies a first current Ir to the resistance R1 and a second current Id to the series 21, composed by the resistor R2 and the diode D1.

In particular, the diode D1 has the cathode electrode connected to ground and the anode electrode connected with the resistor R2, and the resistor R1 is connected at one side to ground and at the other side to the resistor R2. At the terminal OUT there is a bandgap reference voltage $V_{BG}$.

The current source I, implemented, for example, by a p type channel mirror, provides a current having a positive slope in temperature. In fact, the current I is proportional to the ratio between the thermal voltage $V_T$ and a resistance R, as mathematical formula (1) sustains.

It is to be noted that the thermal voltage $V_T$ grows with temperature and the resistance R grows with the growth of the temperature as a consequence of the technology used.

The circuit shown in FIG. 1 is able to provide a voltage $V_{BG}$ equal to the bandgap reference voltage multiplied for a scaling factor. This scaling factor, as hereinafter described, is defined by a ratio of resistances.

In fact, referring to FIG. 1, the voltage $V_{BG}$ is defined by the following equations:

$$V_{BG}=I_D*R1 \quad (3)$$

$$V_{BG}=I_D*+R2+V_{D1} \quad (4)$$

where $V_{D1}$ represents the voltage on the diode D1.

By considering that the current I is defined by the formula:

$$I=Ir+Id \quad (5)$$

and by making few algebraic calculations, it is possible to obtain the following equation for the bandgap reference voltage $V_{BG}$:

$$V_{BG}=R1/(R1+R2)*(I*R2+V_{D1}) \quad (6)$$

In equation (6) the term "$I*R2+V_{D1}$" represents the output voltage of a classical bandgap reference circuit, and it values about 1.3V.

However, there is a multiplying factor "R1/(R1+R2)" that is able to scale the value of the output voltage of a classical bandgap reference circuit. Particularly, the multiplying factor "R1/(R1+R2)" allows the scaling of the voltage to 1V.

In this specific embodiment, the reached value by the bandgap reference voltage $V_{BG}$ is about 840 mV.

Referring again to FIG. 1, it is to be noted that there are two current components, that is the current of the source I and Ir, and particularly, as stated by equation (1) the current I is proportional to $V_T/R$, and as stated by equation (3) the current Ir is equal to $V_{BG}/R1$.

These two current components, I and Ir, have opposite slope as a function of the temperature T. That is, they have derivatives of opposite sign:

$$d/dT(I)=d/dt(V_T/R)>0 \quad (7)$$

$$d/dT(Ir)=d/dt(V_{BG}/R1)<0 \quad (8)$$

In this way, it is possible to sum opportunely the two current components, so as to obtain a compensated current in temperature.

Figure 2:
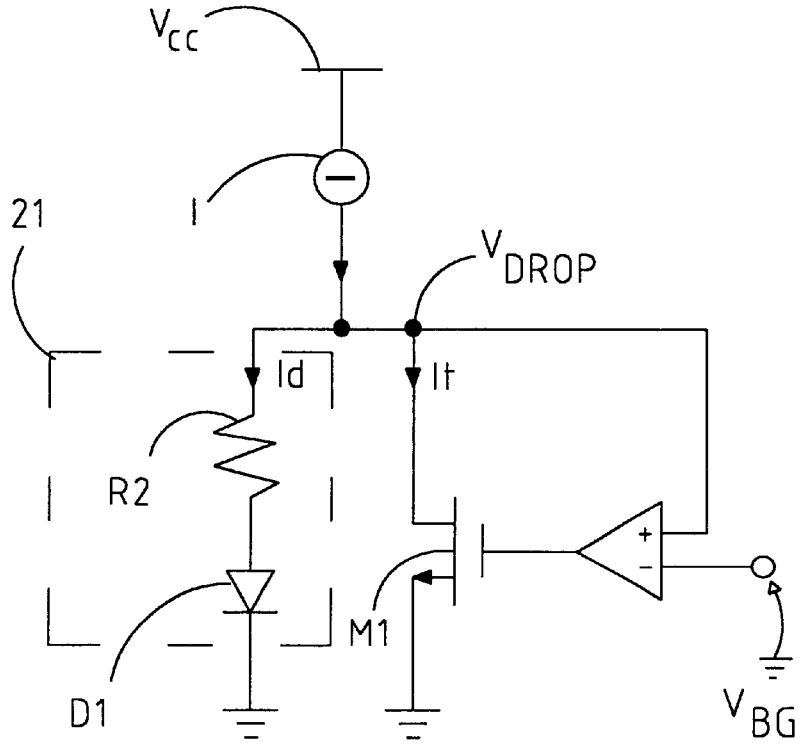
FIG. 2 shows a schematic of a reference circuit according to an embodiment of the present invention.

The inventors have found that by using an improved reference circuit such as that shown in FIG. 2, it is possible to have a current insensitive to temperature changes.

Wherever possible, the same reference numbers are used in FIG. 2 and the following description to refer to the same or like parts.

In FIG. 2, an output stage of a bandgap reference circuit according to one embodiment of the present invention is shown.

As shown in FIG. 2, the resistor R1 (wherein there is the current with negative slope) of FIG. 1 is replaced with an n type channel transistor M1. The transistor M1 has its gate electrode connected with the output of an operational amplifier OP, its source electrode connected with ground and its drain electrode connected with the current source I and the resistor R2. The operational amplifier OP has its positive electrode connected with the drain electrode of the transistor M1 and its negative electrode connected to the bandgap reference voltage $V_{BG}$.

As heretofore described, the current I is provided by the bandgap reference circuit (not shown in figure) and the current source I supplies the series 21 composed by the resistor R2 and by the diode D1, through the current Id, and, in this specific embodiment, the transistor M1, through the current It.

Therefore, if the voltage on the negative electrode of the operational amplifier OP, called $V_{DROP}$, is equal to the voltage $V_{BG}$, also the voltage on the resistor R2 and on the diode D1 is the same.

In this way, it is possible to obtain that the current Id flowing in the series composed by the resistor R2 and the diode D1 is the same as the current Ir, flowing in the output branch of the circuit shown in FIG. 1.

As a consequence, the current It flowing in the n type transistor M1 is the same as the current Ir flowing in the resistor R1.

To realize this equality, the voltages $V_{DROP}$ and the $V_{BG}$ are input to the operational amplifier OP, with the voltage $V_{DROP}$ input to the positive electrode and the voltage $V_{BG}$ input to the negative electrode. The output of the operational amplifier OP is fed back to the gate electrode of the n type transistor M1.

Therefore the operational amplifier OP regulates its output voltage as a function of the equality of the voltage $V_{DROP}$ with respect to the voltage $V_{BG}$, that is when:

$$V_{DROP}=V_{BG} \quad (9)$$

In this way, the current It flowing in the transistor M1 will coincide with the current Ir flowing in the resistance R1.

Figure 3:
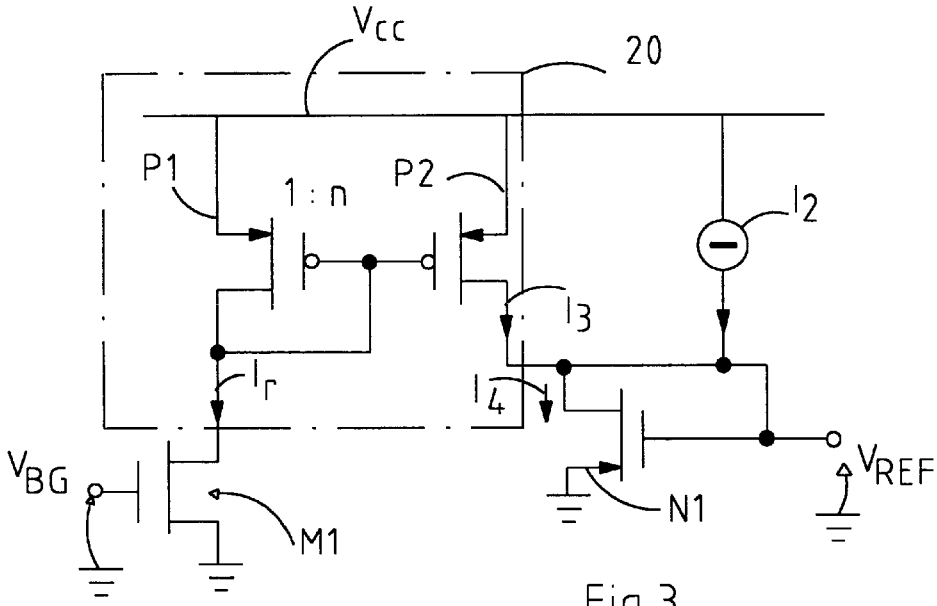
FIG. 3 shows a mixer circuit of the reference circuit of FIG. 2.

In FIG. 3, a mixer circuit of the current reference circuit of FIG. 2 is shown.

Wherever possible, the same reference numbers are used in FIG. 3 and the following description to refer to the same or like parts.

As shown in FIG. 3, the n type transistor M1 is connected at one side to a structure 20, called Widlar's mirror, and at the other side with ground.

The Widlar's mirror 20 is connected to the supply voltage Vcc and is composed of two p type transistors P1 and P2, wherein P1 has its drain and gate electrodes short circuited and its source electrode connected to the supply voltage Vcc, whereas the transistor P2 has its source electrode connected to the supply voltage Vcc and its drain electrode connected with drain of transistor N1.

It is to be noted also that the n type transistor N1 is connected to the drain electrode of transistor P2.

In fact, the transistor N1 has its source electrode connected to ground, its drain electrode short-circuited with the gate electrode and its drain electrode is connected with a current source I2.

The current source I2 is connected at the other side to the supply voltage Vcc.

The current having negative slope, that is Ir, flows through the transistor M1, and it is mirrored and amplified by a factor "n" by the Widlar's mirror 20, giving as a result a current I3 as stated by the following equation:

$$I3=n*Ir \quad (10)$$

The current having the positive slope, that is I2, is amplified by an opportune coefficient "k" by means of another mirror structure (not shown in figure), as stated by the following equation:

$$I2=k*I \quad (11)$$

wherein I is equal to $V_T$/ R.

Therefore, the resulting current I4 on the transistor N1 is defined by the sum of the currents I3 and I2, that is:

$$I4=n*Ir+k*(V_T/R) \quad (12)$$

By modifying the coefficients "n" and "k" in a suitable manner it is possible to obtain a reference current, that is I4, insensitive to the temperature changes. This current I4 provides a voltage $V_{REF}$ that is possible to mirror in every part of the integrated circuit.

Further, it is to be noted that all the transistors depicted in FIGS. 2 and 3 are preferably implemented in HCMOS technology, so that it is possible to realize this output stage (FIG. 2) and the mixer (FIG. 3) in a great variety of CMOS processes.

Figure 4:
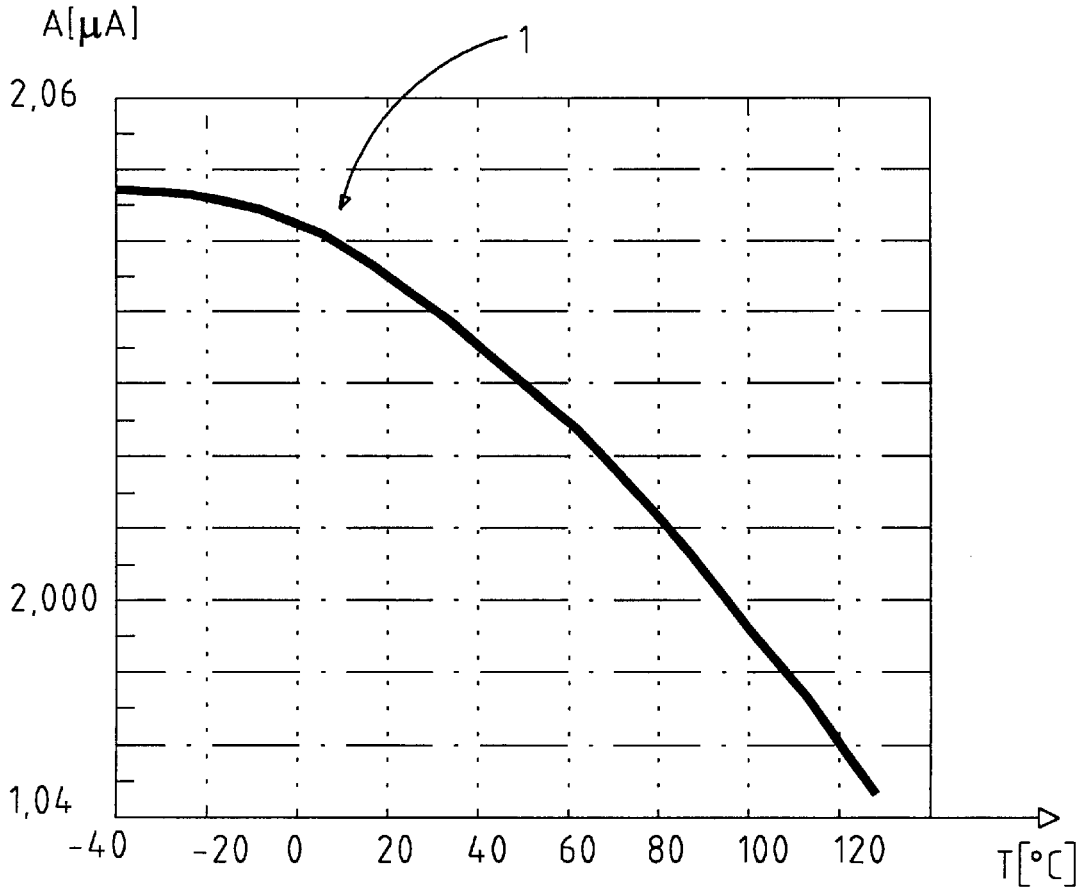
FIG. 4 shows a graph of the trend of the reference current of the circuit of FIG. 3 as a function of the temperature.

In FIG. 4, a graph of the trend of the reference current of the circuit of FIG. 3 as a function of the temperature is shown.

In FIG. 4, there is an abscissa axis representing the temperature, expressed in Celsius degrees, and an ordinate axis representing the current, expressed in μAmperes.

It is to be noted that the current spread as a function of the temperature is about 20 nA in a temperature range of about −40° C. to +125° C.

Figure 5:
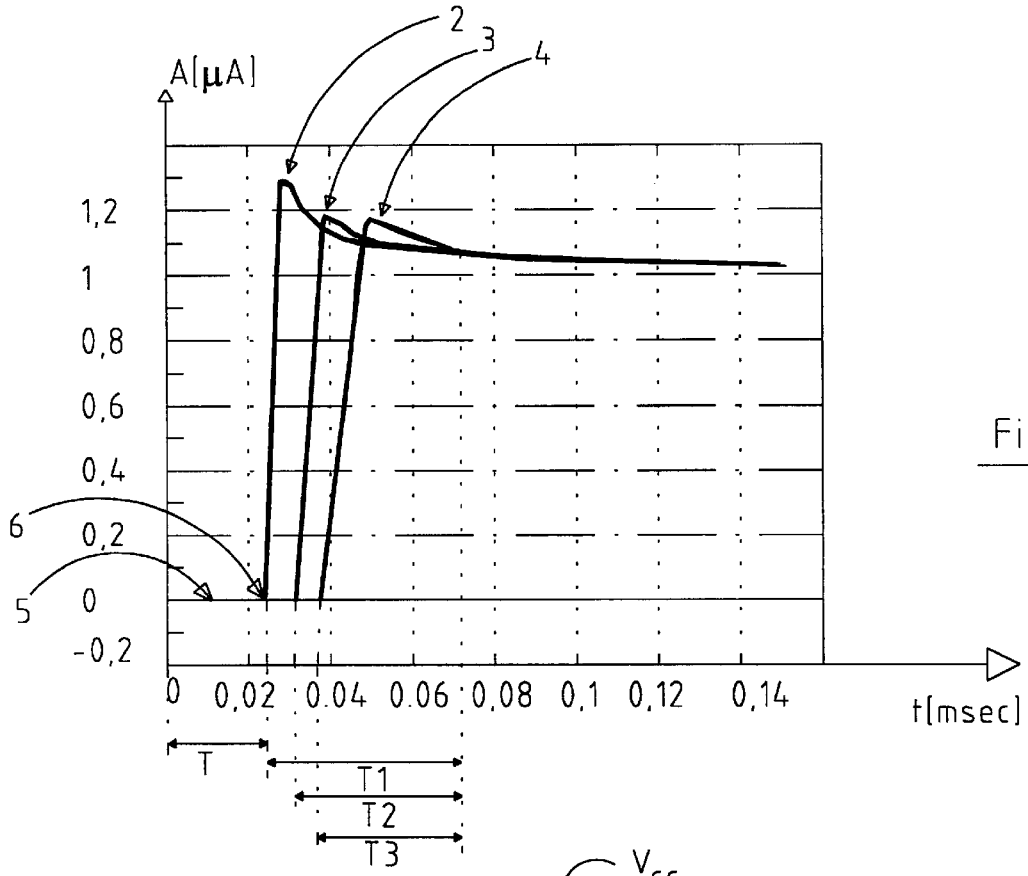
FIG. 5 shows another graph of the trend of the reference current of the circuit of FIG. 3 as a function of the time.

In FIG. 5, another graph of the trend of the reference current of the circuit of FIG. 3 as a function of the time is shown.

In FIG. 5, there is an abscissa axis representing the time, expressed in msecs, and an ordinate axis representing the current, expressed in μAmperes.

It is to be noted that there are depicted three curves 2, 3 and 4. In particular, the curve 2 is the worst situation for the turn on of the inventive circuit shown in FIGS. 2 and 3.

In fact, as previously described, the reference current generation is connected with the bandgap reference voltage, and the curve 2 describes the trend of the reference current for a working condition in which at the time of t=10 μsec the bandgap reference voltage is turned on at a power supply voltage value of about 1.2V.

In this case, the reference current 2 remains fixed to 0A, segment 5, for about a period of T=25 μsec, and after the period T also the reference current is turned on, point 6.

Therefore, the steady condition is reached after a period T1=70 μsec, without the reference current 2 presenting particular over-oscillations.

Referring to the curves 3 and 4, the steady condition is reached in a period, respectively T2 and T3, both smaller than T1.

Therefore, the features of the circuit described in FIGS. 2 and 3 can be summarized in following table:

| $V_{supply}$ | $I_{reference}$ | $\Delta I_{reference}$ | $T_{start\text{-}up}$ | $P_{consumption}$ |
|---|---|---|---|---|
| from 1 V to 1.9 V | 1.05 μA | 20 nA | <70 μsec | ≈3.5 μW |

wherein $V_{supply}$ is the supply voltage or Vcc of the inventive circuit of FIGS. 2 and 3, $I_{reference}$ is the produced reference current, $\Delta I_{reference}$ is the variation in temperature (from −40° C. to 125° C.) of the produced reference current, $T_{start\text{-}up}$ is the start up time in the case of simultaneous turn on of the reference current and bandgap reference voltage (otherwise in the case in which the bandgap reference voltage is already turned on the time $T_{start\text{-}up}$ is about 40 μsec) and $P_{consumption}$ is the power consumption of the supply voltage Vcc.

The inventive reference current circuit, as depicted in FIGS. 2 and 3, needs an operational amplifier that is able to work in the same range of supply voltages as the inventive reference current circuit.

Figure 6:
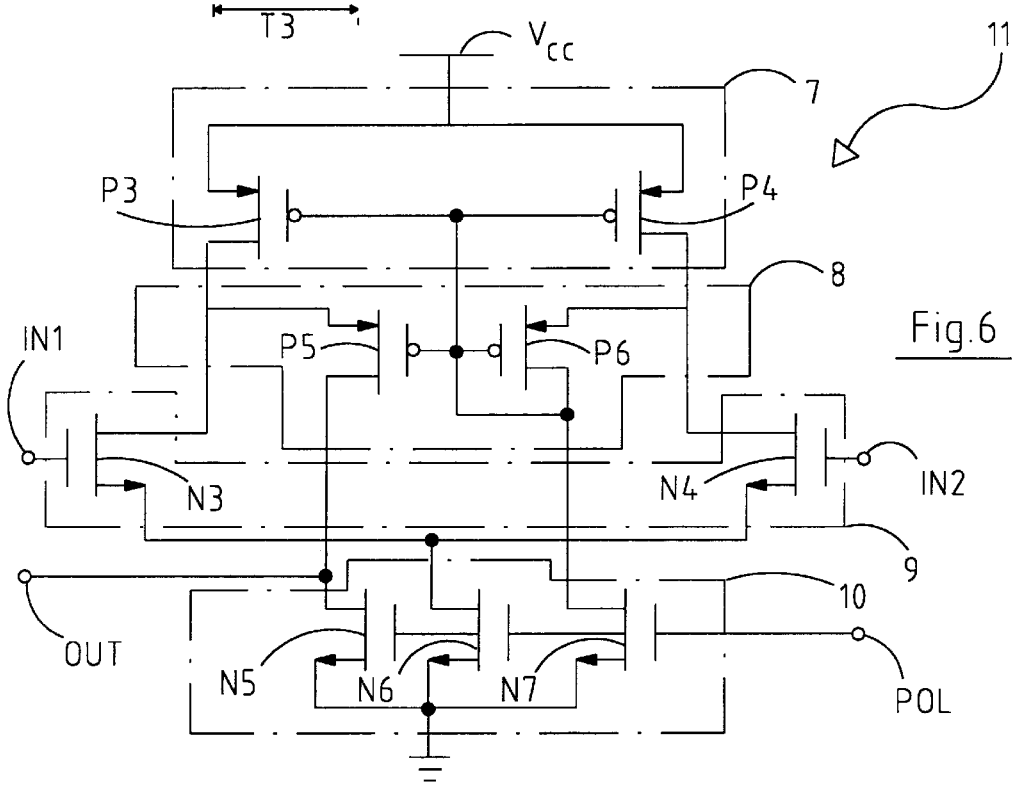
FIG. 6 shows an operational amplifier that is able to work in the same range of supply voltages as the reference current circuit of FIG. 3.

In FIG. 6, an operational amplifier that is able to work in the same range of supply voltages as the reference current circuit of FIGS. 2 and 3 is shown.

With reference to the drawing of FIG. 6, an operational amplifier 11 is defined by a first block 7, connected at one side to the supply voltage Vcc and at the other side to a second block 8; the second block 8 is connected to a third block 9 and the latter to a fourth block 10, which is itself connected to ground.

The first block 7 is a polarization structure, composed of two p type transistors P3 and P4, the second block 8 is known as folded structure, composed of two p type transistors P5 and P6, the third block 9 is an input structure, composed of two n type transistors N3 and N4 and the fourth block 10 is another polarization structure, composed of three n type transistors N5, N6 and N7.

The transistors P3 and P4 have their respective gate electrodes connected to each other, their respective source electrodes connected to the supply voltage Vcc and their respective drain electrodes connected to the source electrodes of the transistors P5 and P6 and to the drain electrodes of the transistors N3 and N4.

The transistors P5 and P6 have their respective gate electrodes connected to each other, and their respective drain electrodes connected to the drain electrodes of the transistors N5 and N7.

Moreover, the gate electrode and the drain electrode of the transistor P6 are connected to each other.

The gate electrode of the transistor N3 is a first input terminal IN1, whereas the gate electrode of the transistor N4 is a second input terminal IN2.

Moreover, the source electrodes of the transistors N3 and N4 are connected to each other and to the drain electrode of the transistor N6.

The transistors N5, N6 and N7 have their source electrodes connected to ground, and their gate electrodes are connected to a polarization terminal POL.

The terminal POL is a polarization terminal adapted for injecting the desired currents in the block 10, that is the currents able to polarize the transistors N5, N6 and N7.

The operational amplifier 11 has the structure of a folded cascode, as is well known to a person of ordinary skill in the relevant art. In fact, between the output OUT and ground, there is only the voltage difference between the drain and source electrodes of the transistor N5, and as consequence the voltage present on the terminal OUT, that is $V_{OUT}$, can drop until 200 mV without any problems of polarization.

By doing, instead, the electric path from the supply voltage Vcc to ground, there is the sum of the voltage difference between the gate and source electrodes of the transistor P4 and of the voltage between the drain and source electrodes of the transistor N7. It is to be noted that the transistor P4 has a threshold voltage less than 600 mV, whereas the transistor N7 has a drain source saturation voltage $V_{DSsat}$ less than 200 mV. Therefore, if the supply voltage Vcc becomes lower than 1V, there are still 200 millivolts of overdrive voltage to the electrodes of the transistor P4.

It is to be noted also that the transistor N6 supports a double value of current with respect to the transistor N5 and N7. In fact, the transistor N6 is preferably implemented with two transistors in parallel, having the same characteristics as the transistors N5 and N7.

Further, it is to be noted that all of the transistors depicted in FIG. 6 are preferably implemented in HCMOS technology, so that it is possible to realize this operational amplifier 11 in a great variety of CMOS processes.

Figure 7:
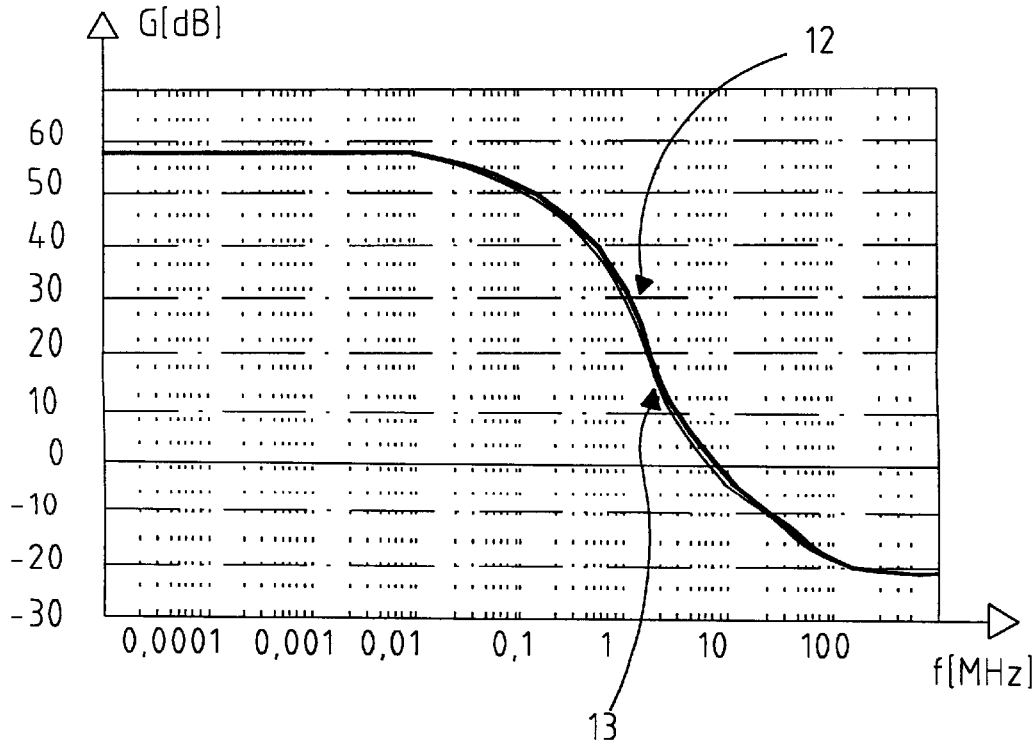
FIG. 7 shows a graph of the trend in frequency of the module of the circuit of FIG. 6 for two given supply voltages.
Figure 8:
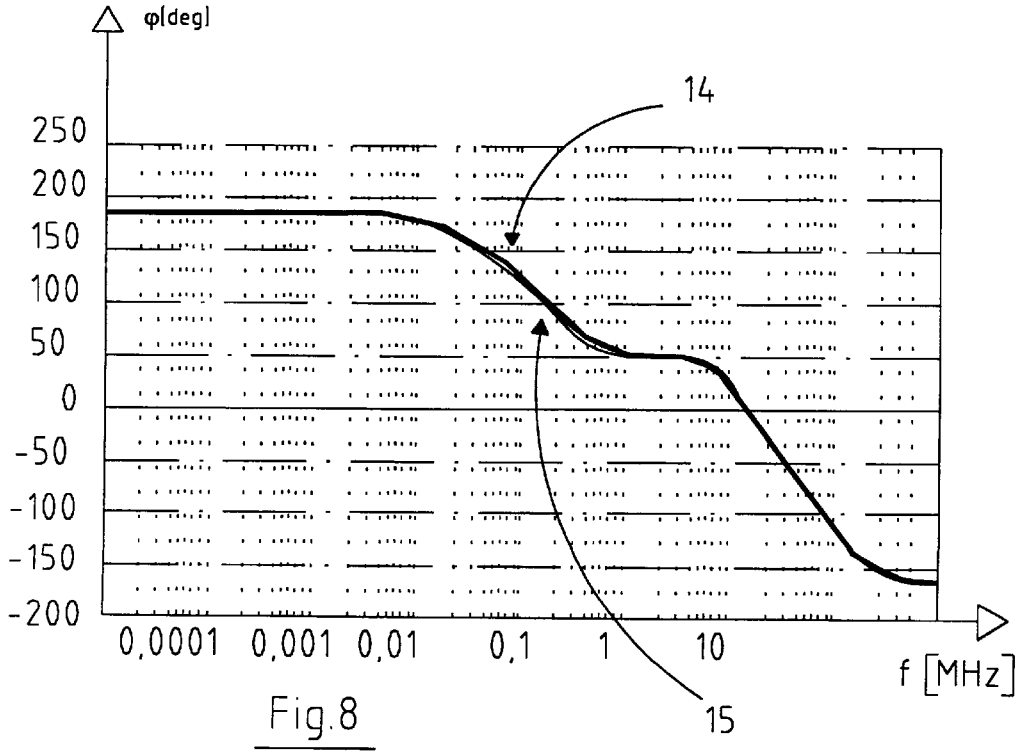
FIG. 8 shows another graph of the trend in frequency of the phase of the circuit of FIG. 6 for two given supply voltages.

In FIGS. 7 and 8, graphs of the trend in frequency of the module and phase of the circuit of FIG. 6 for two given supply voltages are shown.

In particular, in FIG. 7, in which the abscissa axis represents the frequency, expressed in MHz, and the ordinate axis represents the gain, expressed in dB, two curves 12 and 13 are depicted.

The curve 12 represents the output voltage at the terminal OUT in the case of a supply voltage of 1.8V, whereas the curve 13 represents the output voltage at the terminal OUT in the case of a supply voltage of 1V.

As shown in FIG. 7, both curves 12 and 13 show the same gain at low frequency. In fact, for frequencies lower than 0.1 MHz, the gain is about 55 dB.

In FIG. 8, in which the abscissa axis represents the frequency, expressed in MHz, and the ordinate axis represents the phase margin $\phi$, expressed in degrees, two curves 14 and 15 are depicted.

The curve 14 represents the phase margin $\phi$ in the case of a supply voltage of 1.8V, whereas the curve 15 represents the phase margin $\phi$ in the case of a supply voltage of 1V.

In both working conditions the operation amplifier 11 needs to be compensated to achieve the stability.

As shown in FIG. 8, both curves 14 and 15 show the same phase margin $\phi$.

As consequence, the operational amplifier 11 depicted in FIG. 6, does not change its behavior at low supply voltages and further the operational amplifier 11 still has a good gain at low supply voltages.

Therefore, the features of the operational amplifier 11 shown in FIG. 6 can be summarized in following table:

| $V_{supply}$ | G | I |
|---|---|---|
| from 1 V to 1.9 V | 55 dB | 0.5 $\mu$A |

wherein $V_{supply}$ is the supply voltage Vcc, G is the gain at low frequencies, and I is the current dissipation produced by the supply voltage Vcc.

Figure 9:
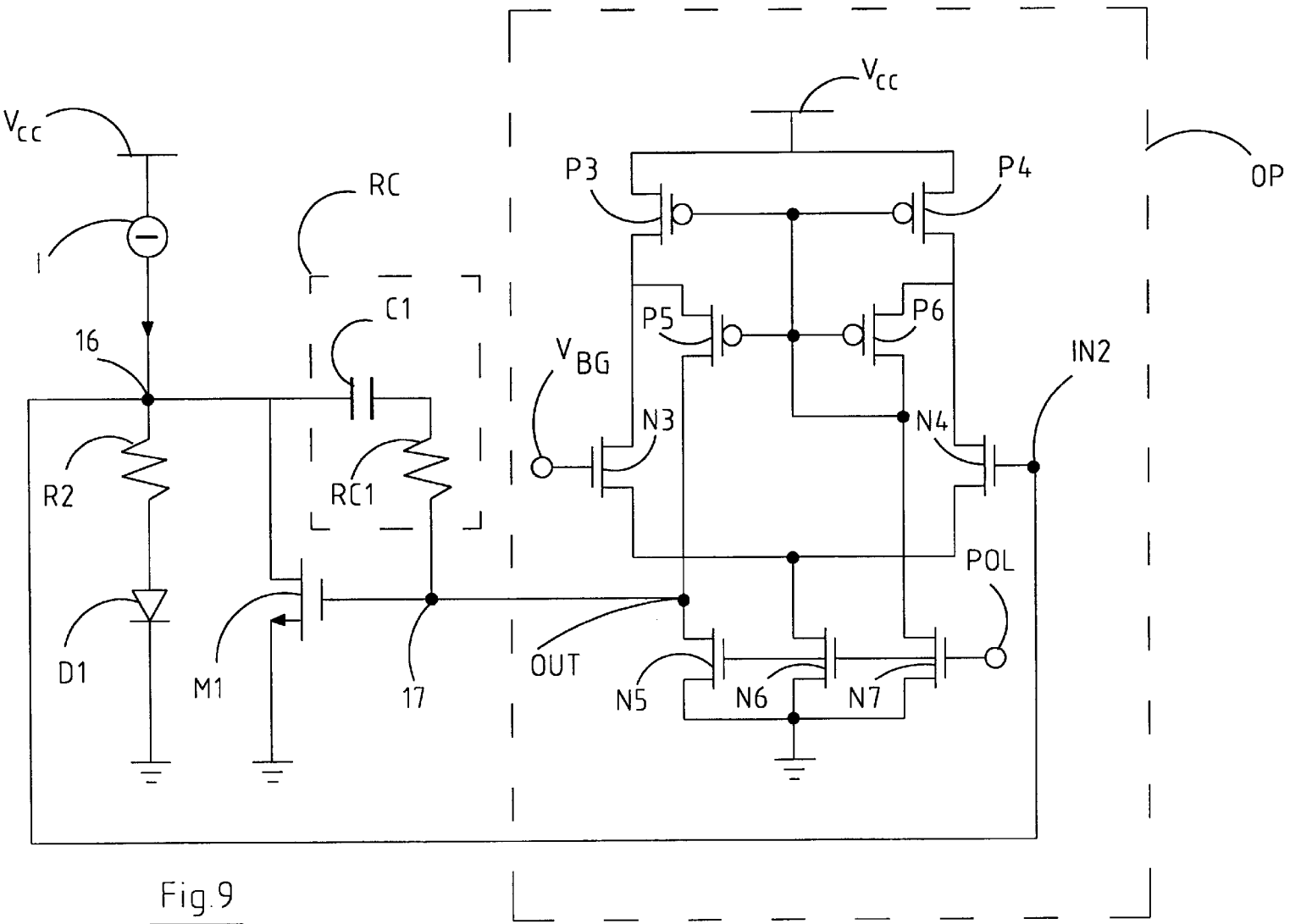
FIG. 9 shows an exemplary embodiment of the present invention in detail.

In FIG. 9, an exemplary embodiment of the present invention is shown in detail.

Wherever possible, the same reference numbers are used in FIG. 9 and the following description to refer to the same or like parts.

It is to be noted that the circuit described in FIG. 9 is an exemplary detailed version of the circuit of FIG. 2. In fact, referring to FIG. 2, the generic operational amplifier OP is now implemented with the operational amplifier heretofore described in FIG. 6.

Moreover, it is to be noted that the input terminal IN2 is connected with the current source I at a point 16 so as to report the drop of voltage $V_{DROP}$, and the input terminal IN1 is the terminal of the band gap reference voltage $V_{BG}$.

Moreover, it is to be noted that this embodiment represents a structure having a negative feedback and a high gain.

In fact, between the point 16, which represents the drain electrode of the transistor M1, and a point 17, which represents the gate electrode of the transistor M1, there is a compensation net RC, composed by a resistor $R_{C1}$, and a capacitor C1.

The inventors has found that exemplary suitable values for the resistor $R_{C1}$ can be at least 100 KΩ and for the capacitor C1 can be at least 2 pF.

As described above, the present structure realizes the equality between the voltages $V_{DROP}$ and $V_{BG}$, and this is achieved through the connection of the two input terminals IN1 and IN2 of the operational amplifier 11 to the voltages $V_{DROP}$ and $V_{BG}$, respectively, and the output terminal OUT to the gate electrode of the transistor M1.

In this way it is possible to control the gate electrode of the transistor M1 so that the operational amplifier OP will maintain a voltage on the gate electrode that is able to stabilize at the same voltage the two input terminals IN1 and IN2. That is, it is possible to realize the equality between the voltages $V_{DROP}$ and $V_{BG}$.

While there has been illustrated and described what are presently considered to be the preferred embodiments of the present invention, it will be understood by those skilled in the art that various other modifications may be made, and equivalents may be substituted, without departing from the true scope of the present invention. Additionally, many modifications may be made to adapt a particular situation to the teachings of the present invention without departing from the central inventive concept described herein. Furthermore, an embodiment of the present invention may not include all of the features described above. Therefore, it is intended that the present invention not be limited to the particular embodiments disclosed, but that the invention include all embodiments falling within the scope of the appended claims.

What is claimed is:

1. A current reference circuit for low supply voltages, said current reference circuit comprising:

a series including a resistor and a diode, the diode having its cathode electrode coupled to ground and its anode electrode coupled to the resistor;

a current source having one terminal coupled to a supply voltage and another terminal coupled to the series;

an operational amplifier having its negative electrode connected to a band gap reference voltage; and a transistor having its gate electrode coupled to the output of the operational amplifier, its source electrode coupled to ground, and its drain electrode coupled to both the positive electrode of the operational amplifier and the current source.

2. The current reference circuit according to claim 1, wherein the operational amplifier includes:

a first polarization block including a first transistor and a second transistor;

a folded cascode block coupled to the first polarization block, the folded cascode block including a third transistor and a fourth transistor that have the same polarity as the first and second transistors;

an input block coupled to the folded cascode block, the input block including a fifth transistor and a sixth transistor that have an opposite polarity than the first and second transistors; and a second polarization block coupled to the input block, the second polarization block including a seventh transistor, an eighth transistor, and a ninth transistor the have the same polarity as the fifth and sixth transistors.

3. The current reference circuit according to claim 2, wherein the first and second transistors of the first polarization block have their gate electrodes connected to each other, their source electrodes connected to the supply voltage and their drain electrodes connected to the source electrodes of the third and fourth transistors and to the drain electrodes of the fifth and sixth transistors.

4. The current reference circuit according to claim 2, wherein the third and fourth transistors of the folded cascode block have their gate electrodes connected to each other, and their drain electrodes connected to the drain electrodes of the seventh and ninth transistors, and the gate electrode and the drain electrode of the fourth transistor are connected to each other.

5. The current reference circuit according to claim 2, wherein the gate electrode of the fifth transistor acts as a first input terminal, the gate electrode of the sixth transistor acts as a second input terminal, and the source electrodes of the fifth and sixth transistors are connected to each other and to the drain electrode of the eighth transistor.

6. The current reference circuit according to claim 5, wherein the first input terminal is connected to the band gap reference voltage.

7. The current reference circuit according to claim 5, wherein the second input terminal is connected to the current source and to the series.

8. The current reference circuit according to claim 2, wherein the seventh, eighth and ninth transistors of the second polarization block have their source electrodes connected to ground, and their gate electrodes connected to a polarization terminal.

9. The current reference circuit according to claim 2, wherein the first, second, third and fourth transistor are implemented in HCMOS technology and are p type channel MOS transistors.

10. The current reference circuit according to claim 9, wherein the fifth, sixth, seventh, eighth and ninth transistor are implemented in HCMOS technology and are n type channel MOS transistors.

11. The current reference circuit according to claim 10, wherein the eighth transistor is implemented as two n type channel MOS transistors in parallel.

12. The current reference circuit according to claim 1, further comprising a compensation net that includes a first resistor and a capacitor, the compensation net being coupled at one side to the drain electrode of the transistor and at the other side to the gate electrode of the transistor.

13. The current reference circuit according to claim 12, wherein the first resistor has a value of at least about 100 KΩ and the capacitor has a value of at least about 2 pF.

14. The current reference circuit according to claim 1, wherein the current source is implemented by a mirror configuration that is realized by p type channel MOS transistors.

15. An integrated circuit that includes at least one current reference circuit, said current reference circuit comprising:

a series including a resistor and a diode, the diode having its cathode electrode coupled to ground and its anode electrode coupled to the resistor;

a current source having one terminal coupled to a supply voltage and another terminal coupled to the series;

an operational amplifier having its negative electrode connected to a band gap reference voltage; and a transistor having its gate electrode coupled to the output of the operational amplifier, its source electrode coupled to ground, and its drain electrode coupled to both the positive electrode of the operational amplifier and the current source.

16. The integrated circuit according to claim 15, wherein the operational amplifier includes:

a first polarization block including a first transistor and a second transistor;

a folded cascode block coupled to the first polarization block, the folded cascode block including a third transistor and a fourth transistor that have the same polarity as the first and second transistors;

an input block coupled to the folded cascode block, the input block including a fifth transistor and a sixth transistor that have an opposite polarity than the first and second transistors; and a second polarization block coupled to the input block, the second polarization block including a seventh transistor, an eighth transistor, and a ninth transistor the have the same polarity as the fifth and sixth transistors.

17. The integrated circuit according to claim 16, wherein the first and second transistors of the first polarization block have their gate electrodes connected to each other, their source electrodes connected to the supply voltage and their drain electrodes connected to the source electrodes of the third and fourth transistors and to the drain electrodes of the fifth and sixth transistors.

18. The integrated circuit according to claim 16, wherein the third and fourth transistors of the folded cascode block have their gate electrodes connected to each other, and their drain electrodes connected to the drain electrodes of the seventh and ninth transistors, and the gate electrode and the drain electrode of the fourth transistor are connected to each other.

19. The integrated circuit according to claim 15, wherein the current reference circuit further comprises a compensation net that includes a first resistor and a capacitor, the compensation net being coupled at one side to the drain electrode of the transistor and at the other side to the gate electrode of the transistor.

20. A signal processing system that includes at least one current reference circuit, said current reference circuit comprising:

a series including a resistor and a diode, the diode having its cathode electrode coupled to ground and its anode electrode coupled to the resistor;

a current source having one terminal coupled to a supply voltage and another terminal coupled to the series;

an operational amplifier having its negative electrode connected to a band gap reference voltage; and a transistor having its gate electrode coupled to the output of the operational amplifier, its source electrode coupled to ground, and its drain electrode coupled to both the positive electrode of the operational amplifier and the current source.

21. The signal processing system according to claim 20, wherein the operational amplifier includes:

a first polarization block including a first transistor and a second transistor;

a folded cascode block coupled to the first polarization block, the folded cascode block including a third transistor and a fourth transistor that have the same polarity as the first and second transistors;

an input block coupled to the folded cascode block, the input block including a fifth transistor and a sixth transistor that have an opposite polarity than the first and second transistors; and a second polarization block coupled to the input block, the second polarization block including a seventh transistor, an eighth transistor, and a ninth transistor the have the same polarity as the fifth and sixth transistors.

22. The signal processing system according to claim 21, wherein the first and second transistors of the first polarization block have their gate electrodes connected to each other, their source electrodes connected to the supply voltage and their drain electrodes connected to the source electrodes of the third and fourth transistors and to the drain electrodes of the fifth and sixth transistors.

23. The signal processing system according to claim 21, wherein the third and fourth transistors of the folded cascode block have their gate electrodes connected to each other, and their drain electrodes connected to the drain electrodes of the seventh and ninth transistors, and the gate electrode and the drain electrode of the fourth transistor are connected to each other.

24. The signal processing system according to claim 20, wherein the current reference circuit further comprises a compensation net that includes a first resistor and a capacitor, the compensation net being coupled at one side to the drain electrode of the transistor and at the other side to the gate electrode of the transistor.

* * * * *